United States Patent [19]

El Rabaa et al.

[11] Patent Number: 5,018,578

[45] Date of Patent: May 28, 1991

[54] METHOD OF ARRESTING HYDRAULIC FRACTURE PROPAGATION

[75] Inventors: Wadood El Rabaa, Plano, Tex.; R. Clay Cole, Duncan, Okla.; David L. Meadows, Rush Springs, Okla.

[73] Assignee: Halliburton Company, Duncan, Okla.

[21] Appl. No.: 563,765

[22] Filed: Aug. 6, 1990

[51] Int. Cl.[5] ..... E21B 33/138; E21B 43/26

[52] U.S. Cl. ..... 166/281; 166/269; 166/292; 166/300; 166/308

[58] Field of Search ..... 166/269, 270, 271, 281, 166/292, 300, 308

[56] References Cited

U.S. PATENT DOCUMENTS

| | | | |
|---|---|---|---|
| 2,784,787 | 3/1957 | Matthews et al. | 166/281 |
| 2,859,818 | 11/1958 | Hall et al. | 166/269 |
| 3,013,607 | 12/1961 | Bond et al. | 166/269 |
| 3,020,954 | 2/1962 | Graham et al. | 166/281 |
| 3,407,605 | 10/1968 | Coffer et al. . | |
| 3,408,296 | 10/1968 | Kuhn et al. . | |
| 3,530,937 | 9/1970 | Bernard | 166/270 |
| 3,602,302 | 8/1971 | Vincent | 166/281 |
| 3,656,550 | 4/1972 | Wagner, Jr. et al. | 166/270 |
| 3,805,893 | 4/1974 | Sarem | 166/270 |
| 3,871,452 | 3/1975 | Sarem | 166/270 |
| 3,871,453 | 3/1975 | Sarem | 166/270 |
| 3,882,938 | 5/1975 | Bernard | 166/270 |
| 4,031,959 | 6/1977 | Henderson | 166/307 |
| 4,081,029 | 3/1978 | Holm | 166/270 |
| 4,140,183 | 2/1979 | Holm | 166/270 |
| 4,141,416 | 2/1979 | Holm | 166/270 |
| 4,257,483 | 3/1981 | Morris et al. | 166/292 |
| 4,397,353 | 8/1983 | Lacy | 166/269 |
| 4,635,719 | 1/1987 | Zoback et al. | 166/308 X |
| 4,714,115 | 12/1987 | Uhri | 166/308 |
| 4,838,352 | 6/1989 | Obserste-Padtberg et al. | 166/291 |
| 4,842,068 | 6/1989 | Vercaemer et al. | 166/269 |

OTHER PUBLICATIONS

Hartsock, J. H. et al, "The Effect of Mobility Ratio and Vertical Fractures on the Sweep Efficiency of a Five Spot", *Producers Monthly*, Sep. 1961, pp. 2–7.

SPE 16898, "Hydraulic Fracture Propagation in the Presence of Stress Variation" . . . , W. El Rabaa, Halliburton Services, Sep. 1987.

*Primary Examiner*—George A. Suchfield

*Attorney, Agent, or Firm*—Robert A. Kent

[57] ABSTRACT

The present invention relates to a method of hydraulically fracturing a first zone with a first fluid and an adjacent second zone with a second fluid which preferably is chemically reactive with the first fluid to produce a precipitate or gel upon contact therewith. Preferably the fluids are separated from one another in the wellbore and are pumped into their respective zones at approximately the same rate so that they spread radially outward from the wellbore into the formation. Upon contact, the two fluids react with one another to form a precipitate or gel at the interface between the two zones thereby arresting further fracture propagation between the zones.

17 Claims, 1 Drawing Sheet

METHOD OF ARRESTING HYDRAULIC FRACTURE PROPAGATION

BACKGROUND

This invention relates generally to methods and compositions for hydraulic fracturing of subterranean formations. More particularly, this invention relates to a fracturing method which includes the steps of injecting fluids into adjacent formation zones wherein the fluids are preferably capable of reacting with one another at the interface between the two zones to form a fracture-arresting product, preferably a precipitate.

Hydraulic fracturing is a well-known operation used to stimulate oil production. Generally, hydraulic fracturing involves injecting a fracturing fluid into a subterranean oil-bearing formation at an elevated pressure to increase the permeability of the formation. Typically, the fluid is introduced into the formation through a conduit, such as the drill pipe, tubing, or casing. The fluid moves down and outward into the oil-bearing formation from the well bore at a sufficiently high rate and pressure to create fractures and cracks. The minimum downhole pressure required to induce fractures in the formation is often referred to as the "fracture gradient," and is sometimes expressed in terms of p.s.i. per foot of depth from the surface.

The fluids typically used in hydraulic fracturing may comprise any number of materials, including but not limited to water, oil, alcohol, dilute hydrochloric acid, liquified petroleum gas, or foam. In addition to these fluids, solid particles known as propping agents or "proppants" may also be introduced to the formation through the well bore. These proppants, such as sand grains, pellets, or glass beads, fill fractures created during the high pressure stages of the fracturing operation and leave channels for oil to flow through when the pressure is released at the surface.

Subterranean formations typically comprise a number of levels or zones which run substantially horizontally and are layered vertically. Each zone, composed of materials such as rocks, sands, and limestones, has a permeability, porosity, and other properties which is often different from an adjacent zone. One of these properties, of particular interest to the present discussion, is stress. The term "stress," as used herein, refers to tectonic F-forces which occur naturally in subterranean formations and which result from pressures exerted on the zone from different directions. It is recognized that fractures propagate proportionally and in a direction normal to the "minimum" or "least" stress occurring in the formation. Accordingly, the term "stress" as used herein means "minimum stress" unless otherwise provided. Generally, because this minimum stress usually lies in the horizontal direction, fractures tend to propagate vertically. The terms "low stress" and "high stress" as used herein are intended to be relative to one another. Thus, for example, any zone adjacent to a zone of interest having a lower minimum stress than that of the zone of interest is a "low stress zone," while the zone of interest is the "high stress zone."

Some of the problems with hydraulic fracturing include unintended crack propagation and uncontrolled fracture height growth. Often, for example, hydraulic fractures induced in an oilbearing formation eventually "propagate" by spreading into adjacent zones or bounding formations. This propagation has been particularly troublesome in situations where the oil-bearing zone of interest or "pay zone" has an equal or higher minimum stress than the minimum stress of an adjacent zone. It has been discovered that, in such situations, fractures induced in the pay zone tend to propagate toward the adjacent zone. This tendency of fractures to propagate toward a lower stress zone is discussed in an article by W. El Rabaa, entitled "Hydraulic Fracture Propagation in the Presence of Stress Variation," SPE 16898, 205–18, *62nd Annual Technical Conference and Exhibition of the Society of Petroleum Engineers* (Dallas, Texas, Sept. 27–30, 1987). Such fracture propagation may have serious consequences. For example, proppant materials injected into a zone of interest may leak into the adjacent zone. Consequently, fractures induced in the zone of interest, lacking sufficient proppant materials, may "heal" after the pressure is released, possibly requiring another fracturing operation. A further problem is that fractures which have spread into the adjacent zone may remain open after the fracturing operation so that petroleum may leak from the zone of interest into the adjacent zone, resulting in inefficient recovery of petroleum.

The present invention accordingly provides an improved method of hydraulic fracturing which addresses the aforementioned problems. Preferably, this invention controls and/or arrests fracture growth, and in general improves the effectiveness of a fracturing operation, resulting in an improved fracture pattern having reduced propagation from the pay zone into an adjacent zone.

SUMMARY OF INVENTION

This invention relates generally to hydraulic fracturing. In a broad aspect, the method of this invention comprises steps of hydraulically fracturing a first zone, preferably a low stress zone, with a first fluid, and hydraulically fracturing an adjacent second zone, preferably a high stress zone, with a second fluid, preferably one which is chemically reactive with the first fluid. Preferably, the two fluids are segregated from one another at the well bore, e.g., by sealing means such as a packer. The fluids are pumped into their respective zones at approximately the same rate so that they spread radially outward from the well bore. In a preferred embodiment, the first and second fluids react with one another to form a precipitate, so that they tend to form a barrier at the interface between the two zones, thus advantageously arresting fracture propagation between the zones.

In a more particular aspect, the method of this invention comprises fracturing an oil-bearing zone of interest and, in addition, fracturing one or more zones adjacent to the zone of interest. Preferably, the method further comprises sealing and/or arresting the propagation of a hydraulic fracture, particularly a vertical fracture propagating from a high stress zone to a low stress zone. The method in a preferred aspect includes inducing a fracture comprising a first fluid in one zone and a fracture comprising a second fluid in an adjacent zone, so that the two fractures connect or break into one another, resulting in the formation of a precipitous barrier product. The method in another aspect comprises inducing a hydraulic fracture in one zone, preferably a low stress zone, ahead of a hydraulic fracture in an adjacent zone, preferably a high stress zone. Preferably this method comprises increasing the minimum stress in the low stress zone to a level above the minimum stress of the high stress zone, thereby arresting or reducing the propagation of fractures from the high stress zone into the altered low stress zone.

In another broad aspect, the invention comprises a hydraulically fractured subterranean formation with a specified fracture pattern, i.e., one which comprises at least two adjacent zones, a fracture originating in one of the zones comprising a first fluid, preferably sodium silicate, and a fracture originating in the second adjacent zone comprising a second fluid, preferably calcium chloride. The fracture pattern may, in another broad aspect, comprise a reaction between the first and second fluids, wherein the first and second fractures are connected, having broken into one another, thereby providing for sufficient contact between the first and second fluids for the reaction product to form. These formations preferably include perforations in both zones at the well bore. Further, when one of the zones is a pay zone the number of fractures originating in the adjacent zone should be sufficient to contain the fractures originating in the pay zone; that is, the adjacent zone should have more fractures than the pay zone. Such a fracture pattern is unusual when compared to conventional fracturing which focuses inducement of fractures in the pay zone rather than an adjacent zone.

In another broad aspect, the invention comprises a well bore comprising two well bore zones, each comprising a different fracturing fluid, the two fluids preferably being incompatible and reactable with one another. Preferably, the well bore also comprises sealing means for inhibiting or preventing contact between the two fluids at the well bore, e.g., a packer disposed in the annulus between the casing and the drill pipe, positioned in substantial horizontal alignment with the interface between the two zones.

DETAILED DESCRIPTION

Figure 1:
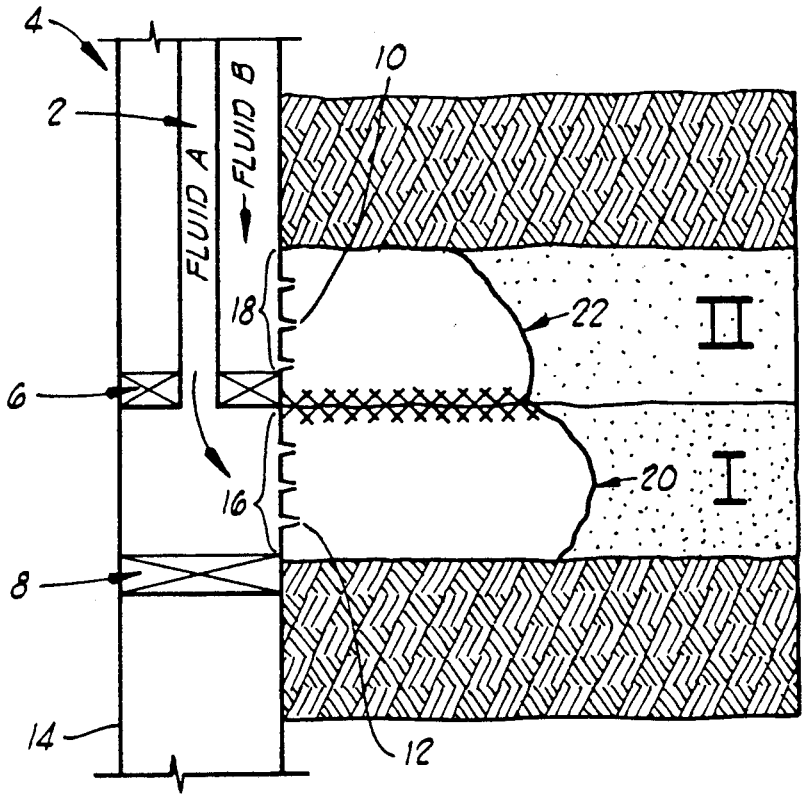

Broadly, this invention relates to hydraulic fracturing of subterranean formations. Various aspects of the invention include a method for hydraulic fracturing; a method of controlling and/or arresting fracture height growth; a subterranean formation comprising adjacent zones which have a specified fracture pattern or series of fractures, wherein the fractures in a zone of interest are preferably contained by fractures in an adjacent zone; and an improved well bore configuration.

In a preferred aspect of the invention, a fracture comprising the first fluid and a fracture comprising the second fluid break into one another, and the two fluids contact, reacting to form a barrier which reduces the permeability of the formation at the point of contact. Preferably, the point of contact is at or proximate to the interface between the two zones, and the barrier comprises a precipitate which prevents or inhibits leakage between the two zones.

In another specific aspect of the invention, fractures comprising the first and second fluids do not break into one another at the interface so that the fluids either do not contact one another at or proximate to the interface of the two zones or do not contact at all. In this aspect of the invention, a fracture comprising the first fluid is formed ahead of a fracture comprising the second fluid at the interface of the two zones. The minimum stress in the first zone preferably increases, more preferably to a level above that of the adjacent second zone, and even more preferably to a level sufficient to arrest propagation of the second fracture from the second zone to the first zone.

In a broad aspect, the hydraulic fracturing method of this invention comprises steps which include hydraulically fracturing a first zone with a first fluid, and hydraulically fracturing a second zone with a second fluid, the second fluid preferably but not necessarily being chemically reactive with the first fluid. In a preferred embodiment, the second zone is the zone of interest and/or has a higher minimum stress than that of the adjacent low stress zone.

The term "fracturing" is intended to have the meaning as discussed above in relation to the production of petroleum, and broadly includes all types of fracturing operations, preferably those fracturing operations which would benefit from this invention, e.g., those which would without this invention result in undesirable crack propagation and proppant and/or fluid leakage between zones. The hydraulic fracturing method of the present invention is performed in accordance with conventional fracturing procedures, the pressures applied to the formation zones being sufficiently high to induce cracks or fractures in the formation, and varying generally depending on the initial permeabilities as well as the desired final permeabilities of the formations.

Before a subterranean formation is fractured in accordance with this invention, it may be desirable to determine the stress profile of the entire formation in order to ascertain whether the stress of the zone of interest is higher than or equal to the stresses of any of the zones adjacent to the zone of interest (hereinafter referred to singularly as the "adjacent zone"). The procedure for identifying a low stress zone and a high stress zone is beyond the scope of this discussion. In general, the stress profile may be established by any one of several known methods, such as microfracturing, strain relaxation, and sonic logs, and the minimum stress of a particular zone may be readily determined by those proficient in that particular technology.

A specific embodiment of the invention is illustrated in FIG. 1 where two fractures (not shown) originating in adjacent zones break into each other at or near the interface of the two zones. In accordance with this embodiment of the invention, the method comprises contacting the two selected fluids at the point where the fractures break into one another. In FIG. 1, for purposes of illustration only, the fractures in both zones propagate vertically, and each fracture in each zone breaks into a corresponding fracture in the adjacent zone at the interface, forming an immobile barrier at the point of contact, thereby tending to arrest further fracture propagation. As indicated, when the fluids come into contact with one another, they preferably combine to form a barrier of reduced permeability and more preferably form an impermeable and immobile sealant barrier. It is particularly desirable that the fluids of this invention form the aforementioned barrier instantaneously upon contacting one another. Accordingly, a preferred first fluid comprises an effective concentration of aqueous sodium silicate while a preferred second fluid comprises a solution of calcium chloride in an amount sufficient to react with the sodium silicate upon contact to form a barrier product.

Referring to FIG. 1, a first fluid (Fluid A) is injected through a tubular member 2 such as tubing. The portion 16 of the well bore 4 situated next to the low stress zone (Zone I) is sealed off with sealing means 6 and 8, preferably a packer. In FIG. 1, the zones above and below Zones I and II are shale. Employing an appropriate fracturing pressure and injection rate, Fluid A is introduced through the drill pipe into the lower zone or portion of the well bore and into Zone I. Preferably, the formation has been previously subjected to a treatment such as perforating to direct the fracturing in the desired direction. As indicated by notches 10 and 12, the casing 14 has been perforated only at Zones I and II so that fluids will not escape from the well bore 4 into any other zones. During injection, the radial movement of Fluid A outward from the lower well bore portion 16 is illustrated by boundary 20 which represents the leading edge of the fluid. As Fluid A proceeds through the formation radially outward from the well bore, fractures (not shown) are induced, primarily vertically.

Shortly after the initial injection of Fluid A, e.g., after a short delay, a second fluid (Fluid B) is injected downward through the annulus between the casing 14 and the drill pipe 3. Employing an appropriate fracturing pressure and injection rate, Fluid B is introduced into the high stress zone (Zone II) which in this case is the zone of interest or pay zone. The movement of Fluid B outward from the upper well bore portion 18 is illustrated by boundary 22, representing the leading edge of the fluid. As indicated in FIG. 1, the relative positions of the leading edges of Fluid A and Fluid B show how the fracture pattern in Zone I "contains" the fracture pattern in Zone II. Referring to FIG. 1, crack propagation may be arrested by forming a low stress fracture in Zone I and a high stress fracture in adjacent Zone II which breaks into the low stress fracture, resulting in the formation of an impermeable precipitous barrier product at or proximate to the interface between the high and low stress zones so that crack propagation is either hindered or stopped completely. The points of contact where such barrier products are preferably formed are indicated by the series of X's.

It is understood that FIG. 1 is only for illustrative purposes. The invention also covers injecting fluids into a subterranean formation in which the low stress zone is located above rather than below a high stress pay zone. In that case, Zone II would represent the low stress zone, and Zone I the high stress zone; Fluid A would be injected first but this time through the annulus; and Fluid B would be injected through the tubing 2. The timing of these injections should be such that the leading edge of Fluid A in Zone II precede and move ahead of the leading edge of Fluid B in Zone I so that the pattern of fractures originating in Zone II contain the pattern of fractures originating in Zone I, and so that fractures originating in Zone I would be more likely to break into fractures originating in Zone II than would be the case if Fluid B preceded Fluid A.

Figure 2:
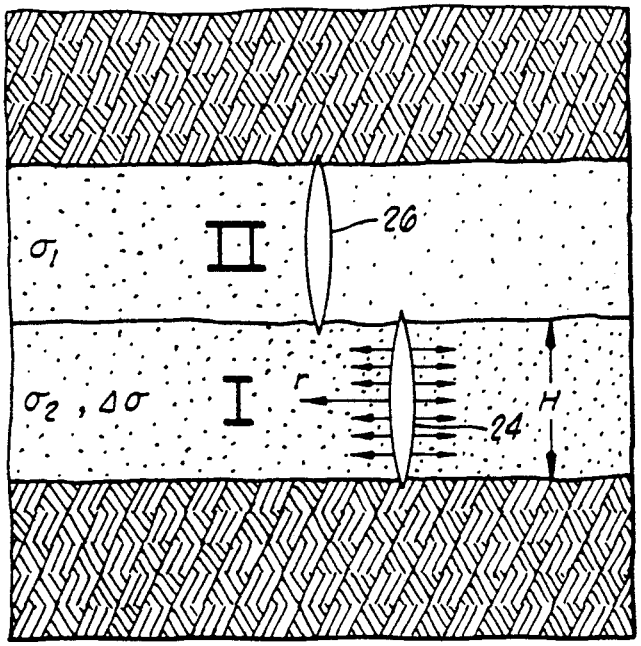

Another specific embodiment of the invention comprises forming a low stress fracture and a high stress fracture, which do not break into one another at the interface of the two zones. FIG. 2 shows the relative positions of fractures in adjacent zones in accordance with this specific embodiment. In a preferred aspect, and referring to FIG. 2, the low stress fracture 24 (in Zone I) is formed ahead of the high stress fracture 26 in (Zone II). Preferably, the method of the invention includes providing an altered stress zone on the trailing edge or well bore side of the low stress fracture, which in turn tends to arrest, i.e., hinder or stop completely, the propagation of high stress fractures into this altered stress zone when the minimum stress of the altered stress zone sufficiently exceeds that of the high stress zone. Referring to FIG. 2, the increase of stress $\Delta\sigma$ produced by fracturing the low stress zone can be approximated by the equation:

$$\Delta\sigma_{near\ center} = \frac{WE}{(1-\nu^2)}\left[\frac{1}{2H} + \frac{rH}{(\sqrt{4r^2+H^2})^3} - \frac{r}{H\sqrt{4r^2+H^2)}}\right]\left\{\begin{array}{c}\text{Plane strain}\\ \text{pressurized crack}\\ \text{Green \& Sneddon}\end{array}\right\}$$

where r is the distance between the center lines of the two fractures; H is the height of the low stress fracture; W is the average width of the low stress fracture; and the symbols E and v signify the elastic constants of the low stress zone. In another aspect of the invention and referring to FIG. 2, it is contemplated that a low stress fracture growing ahead of a high stress fracture creates a localized zone of altered stress on the well bore side or trailing edge side of the fracture. This altered stress zone should be greater than the original stress of the low stress zone. If and when this altered stress ($\Delta\sigma+\sigma_2$) in the localized zone exceeds the stress in the high stress zone($\sigma_1$), fracture propagation from the high stress zone into the low stress zone tends to be arrested due to the presumed tendency of a fracture to not propagate (or propagate less) into a higher stress zone. Thus, in an advantageous aspect of this invention, fracture propagation may be arrested even when fractures do not break into one another at the interface and/or a barrier is not formed.

It is contemplated that a hydraulic fracturing operation performed in accordance with preferred aspects of this invention will include the inducement of fractures of the type shown in FIG. 1 as well as the type shown in FIG. 2. When both types of fractures are induced, it is contemplated that the combined result will satisfactorily reduce the propagation of fractures which have presented problems in the past.

Thus, in one aspect, this invention relates to a method of controlling the propagation of fractures regardless of how the fractures in adjacent zones spread in relation to one another. For example, during a given fracturing operation, a fracture in one zone may break into a fracture in a neighboring zone at the interface of the two adjacent zones. During the same fracturing operation, two other fractures each originating in the different zones may propagate towards one another but pass each other at the interface, leaving some distance between them. Also during the fracturing operation, the fractures may break into each other, not at the interface but at some point in one of the two adjacent zones, i.e., at a "non-interface" point.

Thus, because it is preferred but not essential that all the fractures from each zone break into one another at the interface and the two fluids contact one another, it is not absolutely necessary for the two fluids to be reactive with one another. However, in a preferred embodiment, the two fluids should be reactive with one another. Furthermore, it is contemplated that the mechanisms shown in FIGS. 1 and 2 may both occur at different locations in the same formation.

An important aspect of this invention is the separation of the well bore into at least two well bore zones or portions, the first portion being in horizontal alignment with the formation zone adjacent to the zone of interest, the second portion being in horizontal alignment with the zone of interest. Accordingly, this invention is directed in a broad aspect to an improved well bore configuration. Referring to FIGS. 1 and 2, it can be seen that Fluid A preferably flows into Zone I from the lower portion 16 of the well bore adjacent to Zone I, while Fluid B preferably flows into Zone II from the upper portion 18 of the well bore adjacent to Zone II. This invention is not directed to a fracturing operation where fracturing fluids are unintentionally or inadvertently injected into both the zone of interest and an adjacent zone. However, it is possible that for one reason or another the means for sealing the different well bore zones or portions may not be altogether effective, particularly over an extended period during which time fluids are injected at elevated pressures so that some of Fluid A might flow unintentionally into the upper well bore zone. If a substantial amount of Fluid A were to enter the upper zone at the well bore, followed by injection of Fluid B into the upper zone, the consequences might include a plugging or sealing of the producing zone. Therefore, the zones should be sealed at the well bore in a manner such that, at most, insubstantial amounts of Fluids A and B penetrate the same zone, particularly the zone of interest, at or proximate to the well bore. Accordingly, a preferred aspect of this invention comprises providing a zone or portion of the well bore aligned with the formation pay zone, providing another portion or zone of the well bore aligned with a formation zone adjacent to the pay zone, and separating the two well bore portions, e.g. by sealing one portion from the other.

Although during the fracturing operation of the invention the two fluids are being injected simultaneously, in a preferred aspect of the invention the first fluid is initially injected into the first zone before the second fluid is initially injected into the second zone. Even more preferably, the second fluid is injected after a slight delay following the initial injection of the first fluid. In either case, it is desirable that the first fluid move out into the formation ahead of the second fluid relative to the well bore, causing fractures to form in the first formation zone before and ahead of the formation of fractures in the second zone. The precise timing of the delay should depend on the relative inducement of hydraulic fractures in each formation zone, which may in turn depend on the flow properties in each zone, e.g., permeability. As discussed above, it is desirable for the fractures originating in the low stress zone to be formed before those originating in the high stress zone based on the assumption that high stress fractures tend to propagate into the low stress zone, while low stress fractures tend to propagate less or not at all into the high stress zone. Accordingly, in a preferred aspect of the invention, a high stress fracture propagating from the high stress zone to the low stress zone which breaks into a low stress fracture results in contact between the first and second fluids. Further, where the two fluids are reactive with one another, this contact, which preferably occurs at or near the interface between the two zones, preferably results in formation of a barrier product.

In a broad aspect the present invention may be practiced with any conventional hydraulic fracturing fluid, and it is preferred that the fluids be selected so that they will fracture the formations in the selected zones during pressurized injection. Further, it is preferred that, upon contact with one another, the fluids combine or react to form a barrier product. The reaction or combination of these two fluids should yield an immobile product so that, once a fracture originating in one zone comprising one of the fluids breaks into a fracture in the other zone comprising the other fluid, both fractures are controlled or arrested. This arresting of the fractures may be advantageously accomplished by the formation of the immobile product where a barrier is formed at the point of contact. The barrier should tend to prevent or inhibit either of the fluids from continuing to flow into the other fracture. Further, it is contemplated that where the barrier is an immobile precipitate such as that produced by the reaction between sodium silicate and calcium chloride, the propagation of both fractures will tend to cease or at least be directed away from the interface of the two zones.

In a preferred aspect, the first fluid comprises a solution of an alkali metal silicate, most preferably sodium silicate. Other alkali metals may be used as well, such as potassium, lithium, cesium, and rubidium. Examples of specific alkali metal silicates are sodium and potassium orthosilicate, sodium and potassium metasilicate, sodium and potassium metasilicate pentahydrate, and sodium and potassium sequisilicate. The above-mentioned compounds may be used alone or as mixtures.

Although alkali metals are preferred, other compounds which are bonded with a silicate and which release a silica upon contact with another reactive fluid may be used, such as ethyl silicate and methyl silicate. Other compounds, not enumerated herein but which may be known or discovered by persons skilled in the art and which are also capable of forming a barrier product upon contact with another liquid are also within the scope of the invention.

In a preferred embodiment of the invention, the first fluid which should be injected first into the low stress zone is an aqueous sodium silicate solution. Preferably, the ratio of $SiO_2$ to $Na_2O$ in the sodium silicate should be about 2.33. The concentration of active ingredients in the sodium silicate solution should be from about 5 to about 50 weight percent, the "active" concentration being defined as the combined weight percentage of $Na_2O$ and $SiO_2$. Preferably, to provide formation of a precipitate barrier product upon contact with calcium chloride in the second fluid, the active concentration of sodium silicate in the first fluid should be no less than about 5 percent. A preferred active concentration range is about 20 to about 40 weight percent of the first fluid, with a particularly preferred composition being 38.3 weight percent.

Besides the concentration of the active ingredients in the first fluid, e.g., sodium silicate, another important parameter is the viscosity of the first fluid, which should be sufficiently low to provide for movement of the first fluid radially outward from the well bore through the formation. Thus, the need for a first fluid having a sufficiently high concentration of sodium silicate (or other reactive compound) should be balanced with the need for a first fluid having a sufficiently low viscosity. Accordingly, the active concentration of the first fluid may be varied depending on the desired viscosity, the permeability of the formation, the composition of the second fluid, and the desired strength of the barrier product. In general, the strength of the barrier product will increase proportionally with the concentration of silica in the mixture of sodium silicate solution and activator. For example, assuming the activating agent contains no silica and the barrier product is made with equal proportions of sodium silicate solution and activating agent, a 6 percent by weight sodium silicate solution should yield a barrier product with a 3 percent by weight silica concentration.

In a particularly preferred embodiment, the first fluid is a liquid sodium silicate solution having a specific gravity of 1.39 gm/cc and a viscosity of 200–210 centipoise at 75° C. The sodium silicate solution preferably consists of 9.1% $Na_2O$, 29.2% $SiO_2$ and 61.72% $H_2O$. These are the specifications listed for Grade 40 Sodium Silicate, a commercial product available from Diamond Alkali. Clearly, as will be recognized by those skilled in the art, other concentrations and specifications may be used. In addition to selecting a fluid for its ability to form a strong immobile barrier product, a person familiar with the technology should be guided by the type of formation fracturing requirements and conditions and other considerations typically taken into account in hydraulic fracturing.

The second fluid preferably comprises a compound which yields a barrier product upon contact and sufficient mixing with the first fluid. In a broad aspect, this compound comprises an activator, flocculent, reactive agent, or precipitating agent. Although the second fluid may comprise a gelling agent (e.g., a sealant with an internal catalyst), it is clearly less desirable than a precipitate-forming agent such as calcium chloride. An advantageous feature of the present invention is that, in a preferred embodiment, the first and second fluids maintain their low viscosities until they contact one another at the interface between the two zones. Further, in addition to reacting with the first fluid, the second fluid is preferably such that it will effectively fracture the second zone to increase its permeability. The second fluid should be chosen not only for its effectiveness as a fracturing fluid, but also for its ability to quickly form a barrier product upon contact with the first fluid. It should be incompatible with the first fluid in the sense that the two should not mix to form a third solution, but rather should form a precipitate as instantaneously as possible. Thus, the second fluid should comprise a compound which is in some way reactive with the alkali metal silicate or the other compounds substituted for the alkali metal silicate. Preferably, the second fluid reacts instantaneously with the alkali metal silicate in the first fluid to form an immobile precipitate. Preferably, the second fluid comprises an effective amount of a divalent cation salt. More preferably, the second fluid comprises a solution of calcium chloride which, upon contact and mixing with sodium silicate, yields a calcium silicate precipitate. More broadly, the second fluid may include, for example, acids and acid precursors such as chlorine, sulfur dioxide, sulfur trioxide. It is also contemplated that the second fluid may comprise aqueous solutions of water-soluble salts of divalent metals such as the halide and nitrate salts of iron, aluminum, calcium, barium, strontium, cobalt, nickel, copper, mercury, silver, lead, chromium, zinc, cadmium and magnesium. However, when the first fluid comprises a sodium silicate solution, it is preferred that the second fluid comprise a solution of calcium chloride.

Various embodiments and modifications of this invention have been described in the foregoing description. Such embodiments and modifications are not to be taken as limiting in any way the scope of the invention, which is defined by the following claims. Other variations of what has been described also fall within the scope of the invention. For example, both first and second fluids may comprise, in addition to the compounds mentioned above, additional ingredients, including propping agents and conventional fracturing fluids. Further, even though it is preferred that the first fluid comprise sodium silicate and the second fluid comprise calcium chloride, other fluids which are not delineated herein also fall within the broad scope of the invention.

What is claimed is:

1. A method of hydraulically fracturing a subterranean formation, comprising injecting a first fluid through a well bore into a first formation zone and injecting a second fluid through the well bore into a second formation zone which is adjacent to the first zone, said first and second fluids being injected at pressures sufficient to induce fracturing in both formation zones, contacting said first and second fluids in the subterranean formation proximate the interface between the first and second formation zones whereby a barrier product is formed which substantially arrests propagation of fractures from one zone into the other formation zone.

2. The method of claim 1 additionally comprising separating said well bore into a first portion horizontally aligned with the first formation zone and a second portion horizontally aligned with the second formation zone.

3. The method of claim 1 additionally comprising sealing the well bore to reduce the flow of the first fluid into the second formation or the flow of the second fluid into the first formation zone.

4. The method of claim 1 wherein the minimum stress of the second zone is greater than or substantially equal to the minimum stress of the first zone.

5. The method of claim 1 wherein the first fluid is initially injected before the initial injection of the second fluid.

6. The method of claim 5 additionally comprising a delay between the initial injection of the first fluid and the initial injection of the second fluid, said delay being sufficient to provide for inducement of fractures in the first zone ahead of fractures in the second zone.

7. The method of claim 6 wherein the fractures in the first zone are induced sufficiently ahead of the fractures in the second zone to provide for raising the minimum stress in the first zone.

8. The method of claim 7 wherein the minimum stress in the first zone is raised to a level above the minimum stress in the second zone.

9. The method of claim 8 where the minimum stress of the first zone is raised an amount sufficient to arrest fracture propagation from the second zone to the first zone.

10. The method of claim 1 wherein the first fluid is chemically reactive with the second fluid.

11. The method of claim 1 wherein the first fluid is capable of forming an insoluble precipitate upon contact with the second fluid.

12. The method of claim 1, wherein said first and second fluids form the barrier product, thereby arresting the propagation of fractures from the second zone into the first zone.

13. A method of fracturing a subterranean formation, comprising:

separating a well bore into two portions, the first portion being in horizontal alignment with a first formation zone, the second portion being in horizontal alignment with a second formation zone which is adjacent the first formation zone;

injecting fluid into said first formation zone through said first well bore portion to hydraulically fracture said first formation zone;

injecting fluid into said second formation zone through said second well bore portion to hydraulically fracture said second formation zone; and breaking into said first fracture with said second fracture;

contacting said first fluid with said second fluid in said subterranean formation; and forming a product from the reaction between said first and second fluids in an amount sufficient to inhibit said second fracture from propagating substantially further toward said first zone.

14. A method of hydraulically fracturing a subterranean formation which includes a first zone and a second zone, said first and second zones being adjacent to one another, said method comprising the steps of:

sealing a well bore at a point proximate the interface between said first and second zones;

injecting a first fluid to the first zone through the well bore at a pressure sufficient to induce fracturing in said first zone;

injecting a second fluid to the second zone through the well bore at a pressure sufficient to induce fracturing in said second zone;

contacting said first fluid with said second fluid proximate the interface between said first and second zones whereby upon contact and sufficient mixing with one another said first and second fluid are capable of forming a barrier product which substantially arrests propagation of fractures from one of the formation zones into the other adjacent formation zone.

15. The method recited in claim 14 wherein said first fluid and said second fluid form an insoluble precipitate upon reaction with one another.

16. The method recited in claim 15 wherein said first fluid comprises sodium silicate and said second fluid comprises calcium chloride.

17. The method recited in claim 14 wherein the well bore comprises a conduit, a casing, and an annulus disposed between the conduit and the casing, the fluid injected into the first zone is a first fluid and the fluid injected into the second zone is a second fluid which is different from said first fluid, said first fluid is injected through the conduit in said well bore, and said second fluid is injected through the annulus between the conduit and well casing.

* * * * *